United States Patent [19]

Lub

[11] 4,126,298

[45] Nov. 21, 1978

[54] COMPENSATION DEVICE FOR A CRANE

[75] Inventor: Dirk J. C. Lub, Vlaardingen, Netherlands

[73] Assignee: N.V. Industrieele Handelscombinatie Holland, Rotterdam, Netherlands

[21] Appl. No.: 793,435

[22] Filed: May 3, 1977

[30] Foreign Application Priority Data

May 5, 1976 [NL] Netherlands ..... 7604801

[51] Int. Cl.[2] ..... B66D 1/48

[52] U.S. Cl. ..... 254/172; 212/3 R; 214/13

[58] Field of Search ..... 214/13, 14; 212/3, 61; 254/172, 173, 189

[56] References Cited

U.S. PATENT DOCUMENTS

| | | | |
|---|---|---|---|
| 3,606,854 | 9/1971 | Lunteren | 254/172 |
| 4,025,055 | 5/1977 | Strotenberg | 212/3 |

*Primary Examiner*—Lawrence J. Oresky
*Attorney, Agent, or Firm*—Young & Thompson

[57] ABSTRACT

A ship-mounted crane is provided with a compensation device for ensuring that its load rope will suspend a load selectively stationary relative to the ship, or stationary relative to a load-receiving surface relative to which the ship moves. For this purpose, the crane is provided with a second rope separate from the load rope, and main and auxiliary pneumatic springs movable independently of each other. The load rope is trained about the main pneumatic spring; while the second rope is trained about both pneumatic springs and is selectively connectible to the load-receiving surface.

3 Claims, 1 Drawing Figure

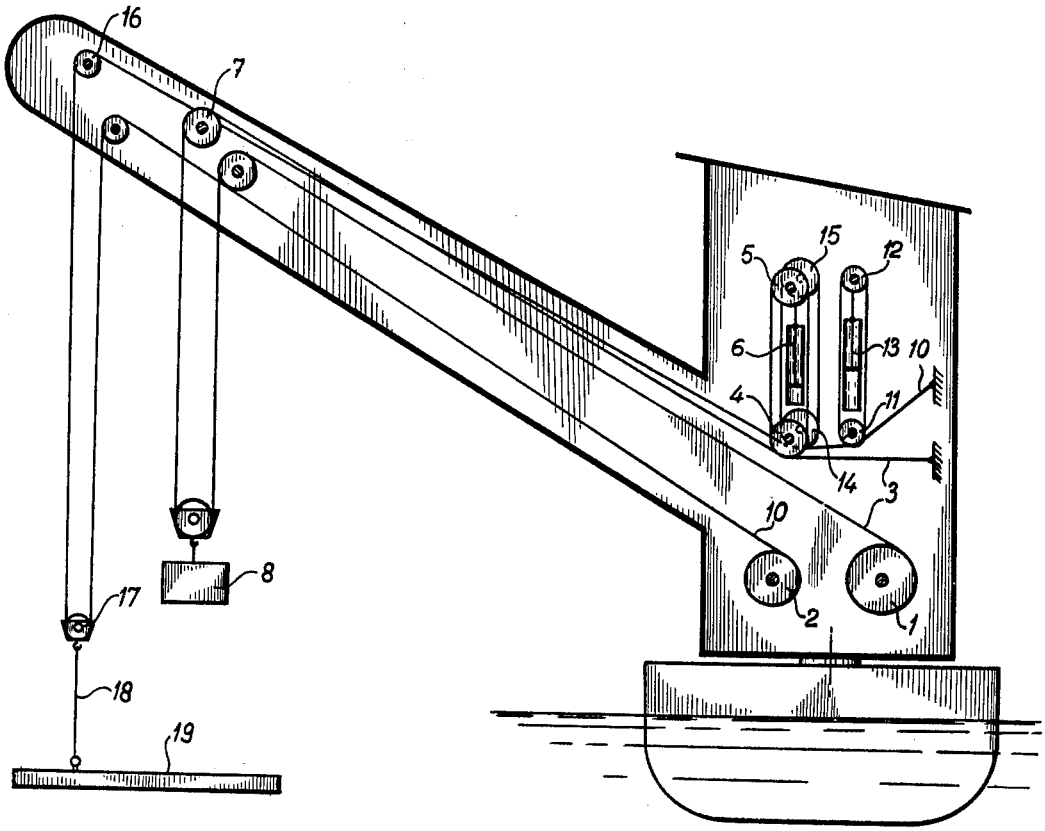
16
7
15
5
12
6
13
10
4
11
14
3
10
8
17
2
1
18
19

COMPENSATION DEVICE FOR A CRANE

The invention relates to a compensation device for a crane or similar hoisting machine consisting of a controllable pneumatic main spring in the track of the load rope, a measuring rope which can be provided between the crane and the surface upon which a load has to be put down or from which the load has to be picked up, as well as means which are controlled by this measuring rope for controlling the pneumatic spring, such that differences in the movement between the load and said surface can be compensated. Such compensation devices are known. They serve for providing that when a load e.g. is put down from a ship which is moving by the waves onto another ship or platform the movements of the load and the load receiving surface are equalized. The known devices which serve for attaining this object are complicated in construction and in use and generally comprise a servo-device which is controlled by the measuring rope.

The invention aims to provide a simple solution for this problem and according to the invention this object is attained by the fact that the measuring rope not only has its own pneumatic auxiliary spring but also is coupled with the controllable pneumatic main spring.

In case of a crane which is provided with a main hoisting apparatus and a top hoisting apparatus, both can be realized in a simple manner by having the rope of the top hoisting apparatus run over the auxiliary spring and over the main spring and by fixing a fastening rope to its load hook. By means of this fastening rope, which together with the top hoisting means functions as a measuring rope, the crane can be coupled with the load receiving surface. The movements of the crane with respect to the load receiving surface remain possible by the presence of the pneumatic springs. A load which is suspended by the load rope normally will follow the movements of the crane. When now the measuring rope is connected to the loading receiving surface and when this rope is stretched until the auxiliary spring is moving around its central position, then the load is always still moving with the crane. When now the pressure in the pneumatic main spring is controlled in such a way that the auxiliary spring is brought to a stop then the main spring behaves in the same manner for the measuring rope as for the load rope which means that the load is coming to a stop with respect to the load receiving surface and so can be put down. It is important that on the basis of the movements of the pneumatic auxiliary spring it can be decided whether it is justified to start with moving the load.

The invention will be further explained by means of the schematic drawing.

The drawing shows a crane which is disposed on a ship and has a main hoisting winch 1 and a top hoisting winch 2. The load rope 3 runs over the pulleys 4 and 5 of a pneumatic spring 6 and further via the deflection roll 7 in the jib to the load 8.

The second rope 10, of the top hoisting winch 2, runs over the pulleys 11 and 12 of a pneumatic auxiliary spring 13 and further over the pulleys 14 and 15 of the pneumatic main spring 6 and then over the top roll 16 to the load hook 17 to which a fastening rope 18 is fixed which can be connected to the put down surface 19.

When now a load 8 has to be put down from the ship onto the surface 19 then the following is done. The pneumatic cylinder 6 is brought on its maximum pressure corresponding to its extended position. The load 8 which is tilted from the ship now will move together with the crane while it is suspended from the latter.

Now the rope 18 is connected to the surface 19 and the rope 10 is stretched by turning the hoisting winch 2 until the auxiliary spring 13 is moving around its centre position. So this auxiliary spring then is absorbing the movements of the ship with respect to the load receiving surface but the load still moves together with the crane. When now the pressure in the spring 6 is decreased until the movements of the spring 13 cease, the point is reached that the movements of the load rope 3 are equal to those of the measuring rope 10, 18 and therefore the load 8 is no longer moving with respect to the load receiving surface and so can be put down on this surface by means of the main hoisting winch 1.

When a load has contacted the load receiving surface in the described way then the load can be fully put down by further slackening rope 3. By doing so the pneumatic main spring 6 again reaches its extreme position and the pneumatic auxiliary spring 13 is taking over again the compensation of the measuring rope.

The invention is very simple and can always be applied regardless of the relative movements between the ship and the load receiving surface. The latter can move also in which case the movements of the load are made equal to those of the load receiving surface by the means according to the invention.

Preferably the compensation system described above is situated near the deadends of the ropes 3 and 10. Then the mounting of the system in a crane is more simple and there is less friction and so less wear when the system is not in use because the ropes do not move over additional pulleys.

I claim:

1. Compensation device for a crane or similar hoisting machine for transferring loads between a first support on which the crane is mounted and a second support with said first and second supports moving relative to each other, said compensation device being supported by said first support for movement therewith and comprising a controllable pneumatic main spring, an auxiliary pneumatic spring that is movable independently of said main spring, a load rope trained about said main spring, means for suspending a load from said load rope, a second rope separate from said load rope and trained about both said main spring and said auxiliary spring, and means for releasably connecting said second rope to said second support.

2. Compensation device as claimed in claim 1, said load and second ropes each having one end fixedly secured relative to said first support, first and second winches supported by said first support, the other end of said load rope being reeved about said first winch, the other end of said second rope being reeved about said second winch.

3. Compensation device as claimed in claim 2, said means for releasably connecting said second rope to said second support comprising a load hook carried by said second rope, and a fastening rope interconnecting said load hook and said second support.

* * * * *